United States Patent [19]

Gregg

[11] 4,174,131

[45] Nov. 13, 1979

[54] CLAMSHELL BUCKET APPARATUS AND METHOD OF USING SAME

[75] Inventor: Richard E. Gregg, Houston, Tex.

[73] Assignee: Royce Equipment Company, Division of McGinnes Manufacturing Co., Houston, Tex.

[21] Appl. No.: 898,922

[22] Filed: Apr. 21, 1978

[51] Int. Cl.[2] ..... B66C 3/10

[52] U.S. Cl. ..... 294/70; 37/188

[58] Field of Search ..... 294/70, 110 R, 111, 294/112; 37/183 A, 183 R, 184, 185, 186, 187, 188; 214/147 G; 212/42, 44, 127, 129

[56] References Cited

U.S. PATENT DOCUMENTS

| | | | |
|---|---|---|---|
| 2,205,325 | 6/1940 | Venable | 37/188 |
| 3,934,917 | 1/1976 | Paxton et al. | 294/70 |

*Primary Examiner*—James B. Marbert

*Attorney, Agent, or Firm*—Pravel, Gambrell, Hewitt, Kirk, Kimball & Dodge

[57] ABSTRACT

A single line clamshell bucket apparatus having new and improved guided automatic latching means for effecting positive operation while raising, lowering and operating the bucket apparatus for picking up and dumping a load.

5 Claims, 7 Drawing Figures

24
A
F
M
40b
16
14
40c
40
L
34
30
40a
32
32c
60
X
10
12
10c
12c
20
22

BUCKETS DOWN AND OPEN, READY TO LOAD

BUCKETS UP AND CLOSED LOADED, (FIG. 1)

BUCKETS DOWN AND CLOSED
READY TO DUMP

BUCKETS UP AND OPEN
DUMPING, (FIG. 3)

CLAMSHELL BUCKET APPARATUS AND METHOD OF USING SAME

CROSS-REFERENCE TO RELATED APPLICATION

This application is related to commonly assigned U.S. Pat. No. 3,934,917 which is hereby completely incorporated herein by this reference for any and all purposes.

BACKGROUND OF THE INVENTION

This invention relates to the field of clamshell buckets and particularly to single line clamshell buckets.

U.S. Pat. No. 3,934,917 and the prior art cited and mentioned therein disclosed single line operated clamshell buckets. While such buckets are desirable in that they are single line operated, they have had disadvantages with respect to the latching mechanism. This mechanism was subject to excessive wear, impact damage, spring failure and the like due to the frequent cycles of operation. In operation, the desired latching and releasing actions were not positively assured due to frequent misalignment.

SUMMARY OF THE INVENTION

The field of this invention is clamshell buckets and in particular single line clamshell buckets.

A single line clamshell bucket is provided with an improved automatic latching mechanism for effecting positive operation. Improved guide means aid in assuring positive operation in each cycle of closing and opening the clamshell bucket by latching and releasing.

An object of the present invention is to provide a new and improved latching mechanism for a clamshell bucket apparatus;

a further object of the present invention is to provide a new and improved method of operating a single line clamshell bucket apparatus;

yet another object of the present invention is to provide a new and improved positive operation for a latching mechanism for a single line operated clamshell bucket assembly.

BRIEF DESCRIPTION OF THE INVENTION

Figure 2:
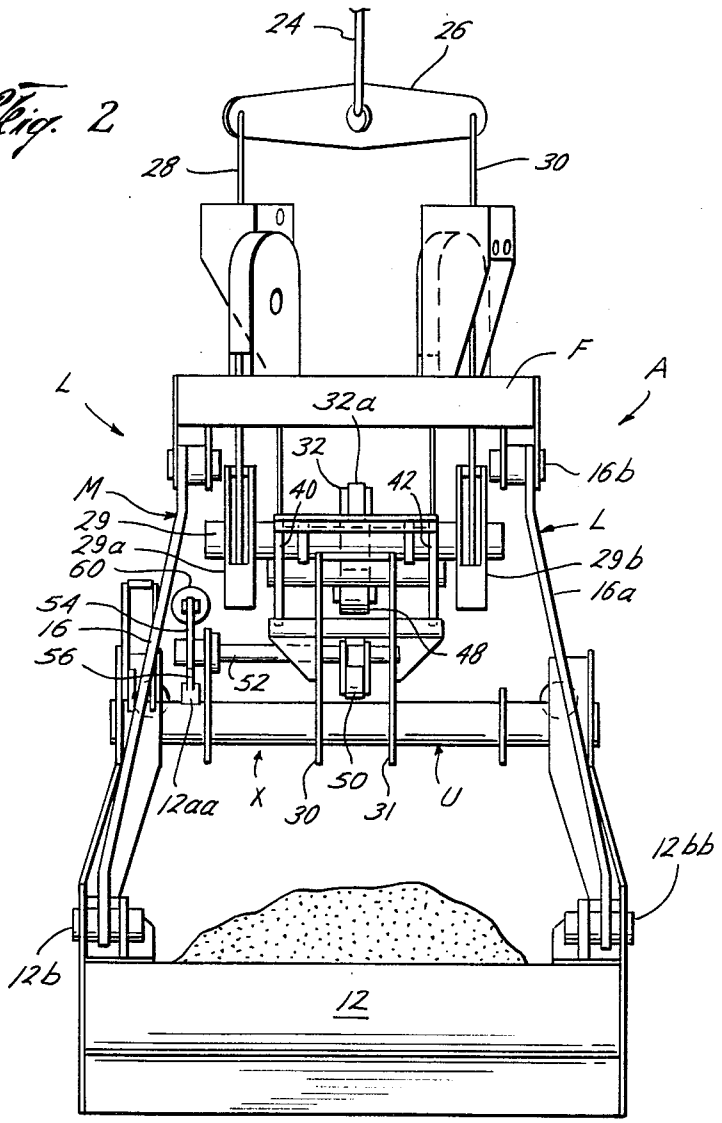
FIG. 2 is a view similar to FIG. 1, but taken at a right angle to FIG. 1.

In the drawings, the reference character A generally designates the clamshell bucket apparatus of the present invention. Such apparatus A broadly includes a pair of clamshell bucket sections 10 and 12 which are essentially duplicates and are disposed opposite each other for operation together, as will be explained. Means are provided, including an upper frame F and a lower frame U for mounting the bucket sections 10 and 12 together for pivotal movement to and from the open position (FIG. 3) and the closed position (FIGS. 1 and 2).

Figure 1:
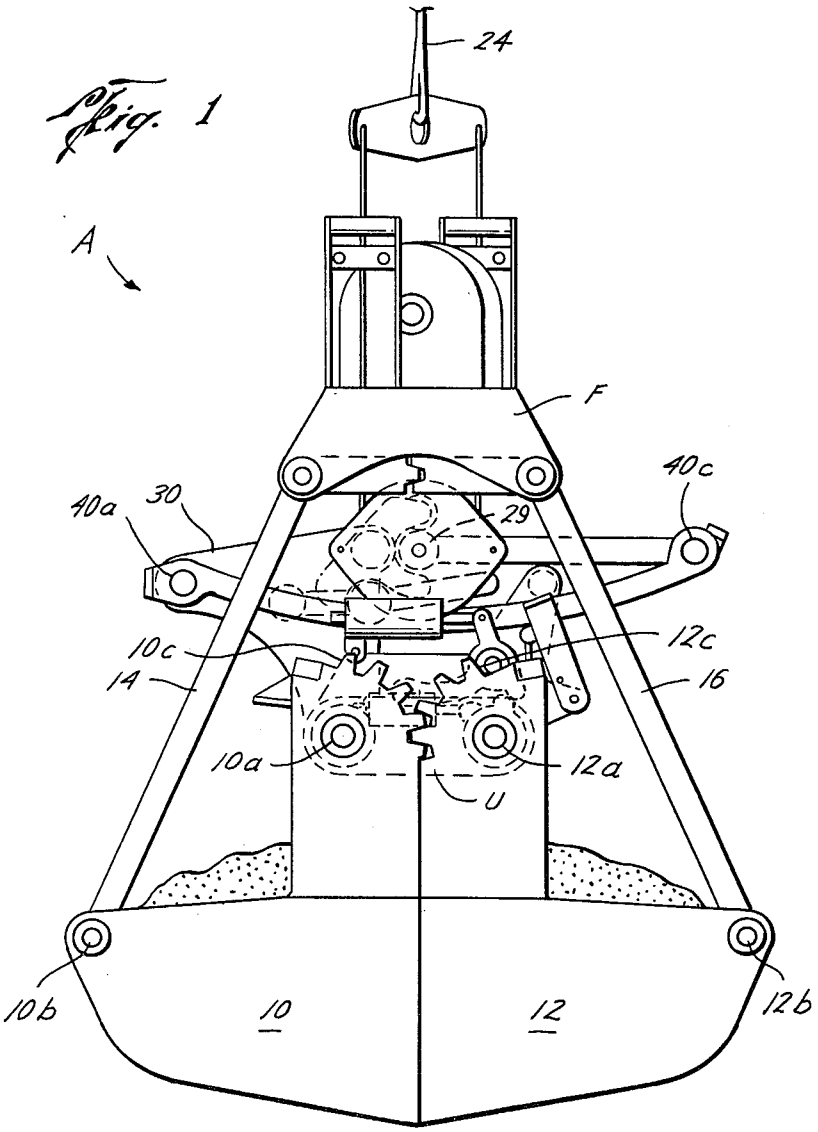
FIG. 1 is a side view, partially in section, of the clamshell bucket apparatus of the present invention.

As illustrated in FIG. 1, the lower frame U pivotally supports the buckets 10 and 12 at 10*a* and 12*a*, respectively, while the upper frame F is pivotally connected to intermediate frame links 14 and 16 which are in turn pivotally connected to the buckets 10 and 12 at 10*b* and 12*b*, respectively. As best illustrated in FIG. 2, the frame link 16 is provided with a corresponding link 16*a* on the other side of the bucket 12. The link 16*a* is illustrated pivotally connected with the bucket of 12*b* and with the upper frame F at 16*b*. The link 16*a* is identical in operation and purpose to the link 16 and another link (not illustrated) corresponding to the link 14 would also be provided. The structural details of the pivotal connection are known to those skilled in the art and will not be set forth in greater detail herein.

The bucket section 10 is provided with a gear tooth portion 10*c* which interengages with the corresponding gear tooth portion 12*c* formed on the bucket section 12 to assure that the bucket sections 10 and 12 move uniformly in relationship to each other between the open and closed positions as is known in the art. The bucket sections 10 and 12 are provided with engageable longitudinally extending leading edges 20 and 22, respectively, which serve to gather the materials to be carried by the clamshell apparatus A into the bucket sections 10 and 12 as the edges 20 and 22 move to the engaged position illustrated in FIG. 1. When the bucket is in the open position (FIG. 3) the edges 20 and 22 are spaced apart in the manner illustrated.

The bucket sections 10 and 12 are substantially similar in details of construction to those disclosed in U.S. Pat. No. 3,934,917 previously incorporated herein by reference.

The improved operating and hoisting means of the present invention is generally designated H in the FIGS. and is preferably a single line system that extends from the clamshell bucket apparatus A to a crane or other lifting instrumentality for elevating and moving the bucket in the desired manner as is well known. The arrangement of the pulleys and the cables on the clamshell buckets is substantially the same as that disclosed in detail in U.S. Pat. No. 3,934,917 and will not be set forth in detail herein. Generally, the single cable support 24 from the operating crane or the like is attached to a yoke 26 having a pair of similarly mounted cables 28 and 30 extending downwardly therefrom and which are in turn connected by a pulley arrangement to the upper frame F and a movable latch-engaging means, generally designated M.

Figure 3:
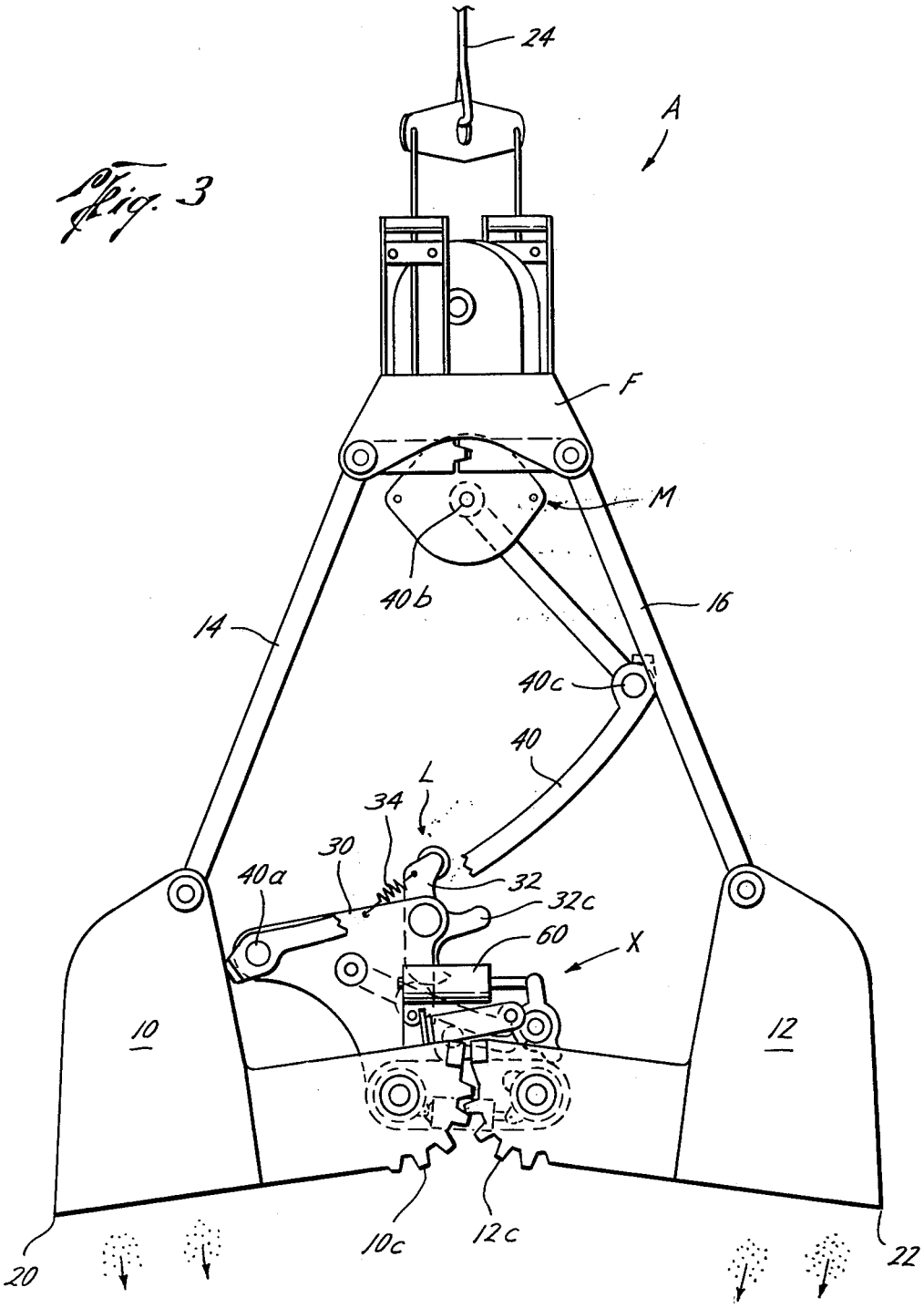
FIG. 3 is a view similar to FIG. 1, but with the clamshell bucket apparatus in the open position.

As best illustrated in FIG. 2, the movable latch-engaging means M comprises a central latch-engaging member 29 having spaced rotatable pulleys 29*a* and 29*b* mounted thereon adjacent opposite ends of the member 29. The member 29 is preferably of circular cross-section and is movable relative to the bucket sections 10 and 12 between a latch-engaged position (FIGS. 1 and 2) and a position out of engagement with the latch (FIG. 3). The latch-engaging means M, through the single line system of pulleys, provides a means for applying a force to the buckets 10 and 12 to move the buckets to the closed position from the open position and when moved from engagement with the latch means also provides the means for supporting the apparatus A from the single line system when the bucket sections 10 and 12 are in the open position (FIG. 3).

The operating and hoisting means H includes the latch-engaging means M as well as latch means, generally designated L, and a latch actuator means, generally designated X.

The latch means L is centrally mounted on the lower frame U and includes a pair of spaced upwardly extending latch support members 30 and 31 (FIG. 2) which pivotally mounts the movable latch member 32 housing the roller 32*a*. The latch support members 30 and 31 are substantially identical and hereinafter the disclosure will refer to support member 31, but it is to be understood that reference is being made to the entire support. A biasing spring 34 connects the latch member 32 and the latch frame 30 in a manner that tends to move the latch member 32 to the released or open position illustrated in FIGS. 3 and 7. The latch member 32 is also movable to a closed position (illustrated in phantom in FIG. 1) where it holds the latch engagement member 29 for operating closed the buckets 10 and 12 enabling lifting and transportation of the material in the clamshell buckets 10 and 12.

During movement, the latch-engaging means L, and particularly latch-engaging member 29, is guided by parallel pivoted guide bars 40 and 42 which are arranged in a parallel relationship inside pulleys 29*a* and 29*b* (FIG. 2). As best illustrated in FIG. 3, the lower portion of the guide bar 40 is secured to the latch frame member 30 and 40*a* and is connected at its upper end 40*b* with the central latch-engaging member 29. A central pivoting connection 40*c* enables the guides 40 to move from the first or extended position (FIG. 3) to the second or collapsed position (FIGS. 1 and 2) when the latch-engaging member 29 is held by the latch member 32. Guide bar 42 corresponds to guide bar 40 and need not be further described. This guide bar linkage is a significant improvement over that disclosed in U.S. Pat. No. 3,934,917 and aids in achieving the positive latching and release of the present invention.

The latch actuator and control means X includes a movable keeper member 48 that is pivotally connected to the latch frame 30 at 48*a*. The keeper member 48 is movable from a latch-engaging position (best illustrated in FIGS. 4 and 5) to a second position spaced from the latch member 32 (FIGS. 6 and 7) for enabling the biasing spring 34 to move the latch member 32 to the released position. The keeper 48 is provided with a rounded portion 48*b* (in phantom) which fits within a corresponding rounded mating portion 32*a* of the latch position 32 when in the first or latch holding position for holding the latch 32 in the closed position. The mating shapes of the surfaces 32*c* and 48*b* are important to the operation of the present invention for as long as the member 29 exerts an upward force on latch 32 the surface 32*a* hold the keeper 48 in the upper position. When the upward pull on the member 29 is relaxed by supporting buckets 10 and 12 other than by cable 24, the keeper 48 will drop away from latch member 32 by the pull of gravity and effect release of member 29 by latch 32 and subsequent opening of the bucket section 10 and 12.

The latch control means X further includes a latch control actuator member 50 having a roller 50*a* mounted on one end for engagement with the keeper 48 for moving the keeper 48 upwardly into engagement with the latch member 32 and surface 32*b* for effecting latching. The member 50 is pivotally connected at 50*b* with the lower frame U and is movable from the first elevated or latching position (FIG. 4) for moving the keeper 48 to the locking or first position and is also movable to the lower position illustrated in FIG. 5. The roller 50*a* reduces wear on the system and increases the positive reliability of operation.

Figure 4:
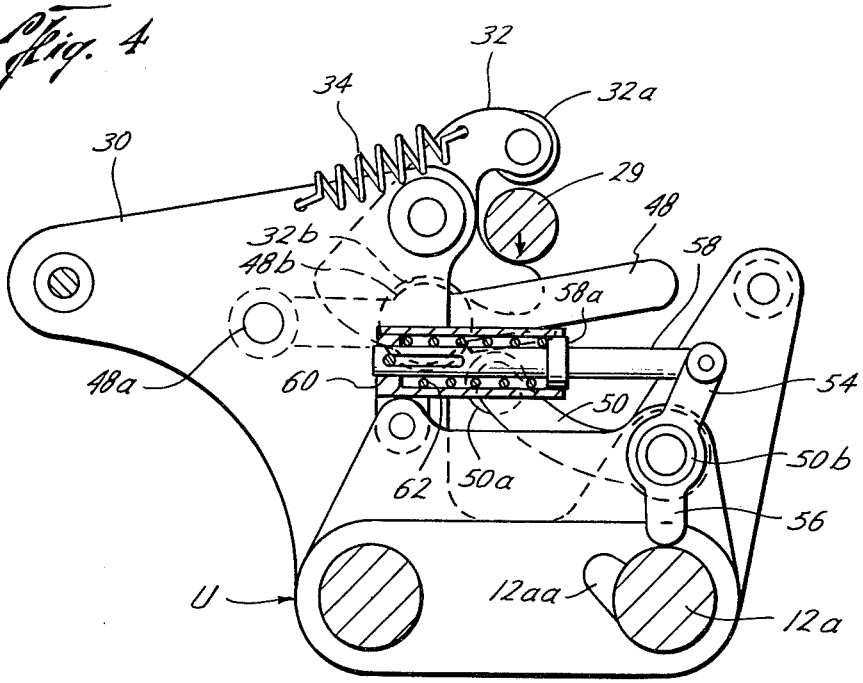
FIGS. 4–7 are side views, partially in section, of the latch mechanism in various conditions of operation.
Figure 5:
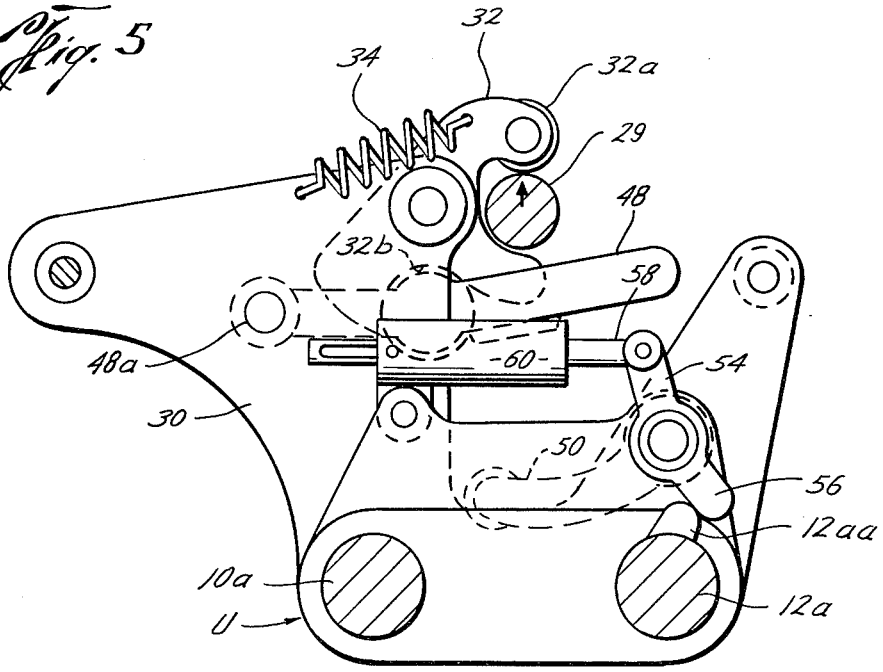
Figure 6:
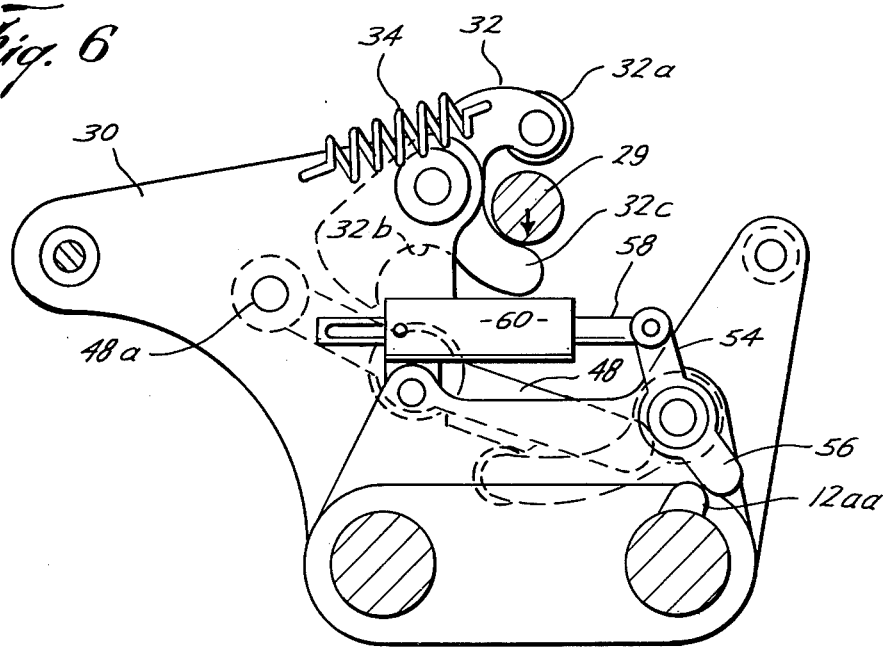

As illustrated in FIG. 5, once the keeper 48 engages the latching recess surface 32*a* of the latch member 32 the actuator member 50 may move from engagement with the keeper 48 without releasing the latch 32 due to the profile of surface 32*a* which holds the keeper 48 in the upper engagement position. The latch actuator member 50 is mounted on a shaft 52 which extends outwardly from the latch frame 30 (FIG. 2) and which mounts a pair of operating levers 54 and 56. The operating lever 54 of shaft 52 is pivotally connected with a shaft 58 extending through spring housing 60 mounted on the latch frame 30. The urging of spring 62 disposed in spring housing 60 on the member 58 urges rotation of the rod or shaft 52 in a manner to rotate the actuator 50 upwardly into the first or upper position in engagement with the keeper 48 for forcing it upwardly (FIG. 4).

The lever arm 56 is disposed for engagement with a cam lobe 12*aa* mounted on the pivot shaft 12*a* of the bucket section 12. When the buckets 10 and 12 move to the closed position, the cam 12*aa*, engages the lever 56 for moving the actuator member 50 to the lower position as illustrated in FIG. 5 and overcoming the urging of spring 62. When the bucket 12 is in the open position cam lugs 12*aa* are spaced from the lever 56 and the spring 62 is free to urge the actuator member 50 upwardly for effecting latching, as illustrated in FIG. 4.

Operation of the Present Invention

The operation and use of the clamshell bucket apparatus A is described in U.S. Pat. No. 3,934,917 which is incorporated herein and need not be further set forth in detail. In general, the utility of this clamshell bucket is to move material such as grain, coal or the like from one location to another. When the leading edges of the clamshell bucket 20 and 22 move inwardly from the open position of FIG. 3 to the closed position of FIG. 1 they manage to scoop or enclose a large segment of material into the bucket for movement to another location where the buckets 10 and 12 open to discharge the material.

For the purpose of the present description, we will commence with the buckets 10 and 12 in the open condition and supported on the single line 24 as illustrated in FIG. 3. When the buckets 10 and 12 are lowered to encounter the material to be picked up the apparatus of the present invention A they will be supported by the material. As line 24 is further played out the latch-engaging member 29 will move downwardly below latch member 32 to the position illustrated in FIG. 3. As the latch-engaging control member 24 moves downwardly to the latch member 32, the roller 32*a* serves to reduce the engagement impact shock therefrom. Further downward movement brings engagement with lower arm 32*c* of latch 32 and pivots latch 32 by overcoming the spring 34 to the position illustrated in FIG. 3. With the buckets 10 and 12 in the open position the cam lugs 12*aa* are removed from engagement with the lever 56 enabling the actuator member 50 to force the keeper member 48 upwardly into the recess 32*a* of the keeper member 32 when the control member 29 has moved below the roller 32*a* and the latch 32 pivoted.

With the buckets 10 and 12 still open and supported on the material, a tightening or increase in tension of the line 24 will pull the member 29 upwardly and which is held by the latch 32. This upward pull will first effect closing movement of the buckets 10 and 12 before lifting of the buckets 10 and 12 from the material. This closing operation is used to fill the buckets 10 and 12 with the material. The latch mechanism 32 is illustrated in FIG. 5 in the position with the buckets 10 and 12 closed, loaded with material and being supported by the latch-engaging member 29 and line 24. With the buckets 10 and 12 in the closed position the cam surface 12*a* engages the arm 56 for overcoming the urging of the actuator frame 62 and moves the actuator member to the lower position. However, the keeper member 48 is engaged in the recess 32*b* of the latch 32 and the upward pull of the latch-engaging member 29 on the latch member 32 engages the surface 32*b* with the rounded portion 48*b* of the keeper 48 for maintaining the keeper 48 in position which prevents the latch 32 from pivoting to the release position.

Figure 7:
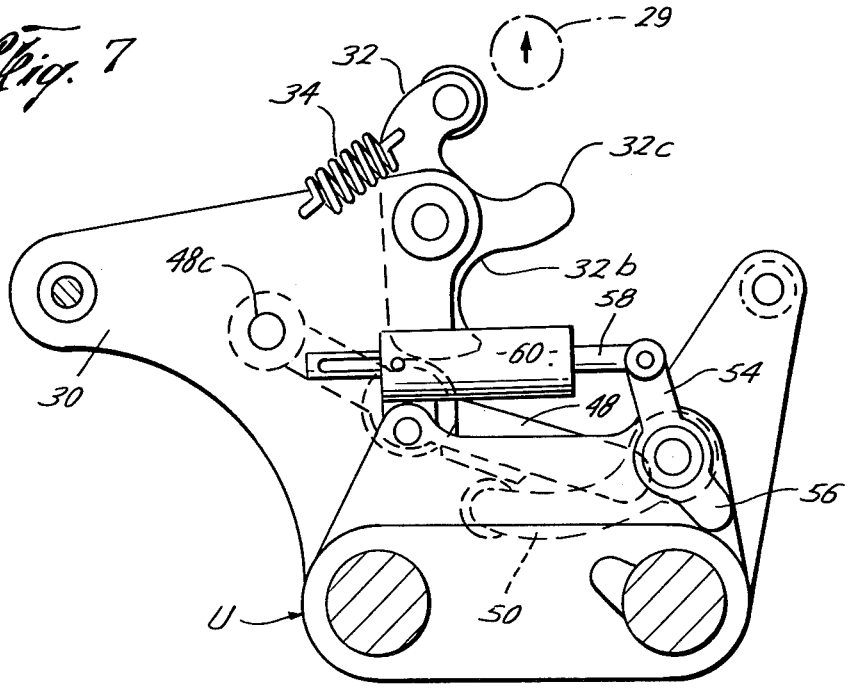

When the buckets 10 and 12 are moves to the position to be discharged, line 24 is played out and the buckets 10 and 12 are lowered to be supported on the ground or the like. When the tension in line 24 is further reduced or the line is slacked off the latch-engaging member 29 will move down slightly to the position illustrated in FIG. 6. This downward movement will engage the lower arm 32*c* of the latch member 32 for effecting movement in the direction opposite to the urging of the string 34 and this movement will release and enable the keeper 48 to pivot downwardly by the force of gravity from the recess 32*b* of the latch 32. Thereafter, when the tension in the line 24 is increased the latch-engaging member 29 is free to move upwardly from the latch member 32 as illustrated in FIG. 7 and enable the spring 34 to move the latch 32 to the released position. As the latch-engaging member 29 continues to move upwardly the buckets move to the open position when the latch-engaging member 29 begins to support the buckets with the line 24 rather than from on the ground. The buckets remain in the open position and this is the condition immediately preceding the beginning of the description herein. In this condition the buckets 10 and 12 are moved back to the material to be moved and are lowered thereon to be supported in the condition illustrated in FIG. 7. When the buckets are supported on the material the latch-engaging member 29 will move downwardly when the line 24 is slacked off to engage the latch member 32 as illustrated in FIG. 4 and which completes a cycle of operation. This cycle of operation is automatically repeated as often as required to move the material from one location to another.

The foregoing disclosure and description of the invention are illustrative and explanatory thereof, and various changes in the size, shape and materials as well as in the details of the illustrated construction may be made without departing from the spirit of the invention.

I claim:

1. A clamshell bucket apparatus, comprising:

a pair of relatively movable and connected clamshell bucket sections each having a scoop configuration with an inner edge which is adapted to be in contact with the other inner edge when the bucket sections are in the closed position and which are moved apart when the bucket sections are in the open position, said clamshell bucket sections connected for uniform movement to and from the open and closed positions;

operating and hoisting means operably connected with said clamshell bucket sections for manipulating said clamshell bucket sections to and from the open and closed positions and for raising and lowering said bucket sections, said operating and hoisting means including:

a single line system adapted to extend from the clamshell bucket apparatus to a crane or the like;

releasable latch means movably mounted with said bucket sections for movement to and from a latching position and a release position;

movable latch-engaging means operably connected with said single line system for movement into engagement with said latch means for applying a force to said buckets to move said buckets to the closed position, and for movement from engagement with said latch means for supporting the entire apparatus from said single line system with said bucket sections in the open position; and latch control means mounted with said bucket section and movable relative thereto between a latched position for holding said latch means in the latched position and a releasable position to enable said latch means to move to the release position, said latch control means to hold said latch means in the latched position when said latch-engaging means moves said latch means to the latched position, said latch control means automatically releasing said latch-engaging means from said latch means by slackening of a single line system when said bucket sections are supported on the ground or the like in the closed position;

means for guiding said latch-engaging means as said means moves longitudinally toward and into latch engagement with said latch means; and said means for guiding including a pair of parallel and spaced guide arms, each of which is pivotally connected at their lower ends with said clamshell bucket section and pivotally connected at their upper ends with said latch engaging means, each of said guide arms having a central pivot for enabling and guiding the movement of said latch-engaging means relative to said latch means.

2. A clamshell bucket apparatus, comprising:

a pair of relatively movable and connected clamshell bucket sections each having a scoop configuration with an inner edge which is adapted to be in contact with the other inner edge when the bucket sections are in the closed position and which are moved apart when the bucket sections are in the open position, said clamshell bucket sections connected for uniform movement to and from the open and closed positions;

operating and hoisting means operably connected with said clamshell bucket sections for manipulating said clamshell bucket sections to and from the open and closed positions and for raising and lowering said bucket sections, said operating and hoisting means including:

a single line system adapted to extend from the clamshell bucket apparatus to a crane or the like;

releasable latch means movably mounted with said bucket sections for movement to and from a latching position and a release position;

movable latch-engaging means operably connected with said single line system for movement into engagement with said latch means for applying a force to said buckets to move said buckets to the closed position, and for movement from engagement with said latch means for supporting the entire apparatus from said single line system with said bucket sections in the open position; and latch control means mounted with said bucket section and movable relative thereto between a latched position for holding said latch means in the latched position and a releasable position to enable said latch means to move to the release position, said latch control means to hold said latch means in the latched position when said latch-engaging means moves said latch means to the latched position, said latch control means automatically releasing said latch-engaging means from said latch means by slackening of a single line system when said bucket sections are supported on the ground or the like in the closed position;

said latch control means includes a biasing spring for moving said latch means to the release position; and said latch control means including a movable keeper mounted with said clamshell bucket section and engageable with said latch means in a first position for holding said latch means in the latching position and movable to a second position for enabling said biasing spring to move said latch means to the release position.

3. The apparatus as set forth in claim 2, wherein:

said latch control means includes a latch control actuator means for moving said keeper means to the first position when said buckets are supported on the ground or the like in the open position.

4. The apparatus as set forth in claim 3, wherein:

said latch control actuator means includes a latch control actuator member for moving said keeper to the first position; and urging means for urging said latch control actuator member for moving said keeper to the first position.

5. The apparatus as set forth in claim 4, wherein:

said latch action actuator means includes cam means actuated when said clamshell buckets are in the closed position for overcoming the urging of said urging means and to move said latch control actuator member from said keeper to enable said keeper to move to the second position.

* * * * *